US006814287B1

(12) United States Patent
Chang et al.

(10) Patent No.: US 6,814,287 B1
(45) Date of Patent: Nov. 9, 2004

(54) PALLET APPARATUS EQUIPPED WITH A RADIO FREQUENCY RECOGNITION MODULE

(75) Inventors: Wei Chang, Hsinchu (TW); Chii-Yah Yuan, Hsinchu (TW); I-Shinn Tien, Hsinchu (TW); Chin-Lu Huang, Hsinchu (TW); Ming-Li Wang, Hsinchu (TW); Tun-Nien Hsu, Hsinchu (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 10/449,088

(22) Filed: Jun. 2, 2003

(51) Int. Cl.[7] ..... G06K 7/08
(52) U.S. Cl. ..... 235/451; 235/492; 340/572.7
(58) Field of Search ..... 235/451, 492; 340/572.7

(56) References Cited

U.S. PATENT DOCUMENTS 6,199,488 B1 * 3/2001 Favaron et al. ..... 108/57.25
6,352,039 B1 * 3/2002 Woods et al. ..... 108/57.25
6,441,740 B1 * 8/2002 Brady et al. ..... 340/572.7
6,452,497 B1 * 9/2002 Finlayson ..... 340/572.8

* cited by examiner

*Primary Examiner*—Michael G. Lee
*Assistant Examiner*—Seung H Lee
(74) *Attorney, Agent, or Firm*—Harness, Dickey & Pierce, P.L.C.

(57) ABSTRACT

A pallet apparatus equipped with a radio frequency recognition module includes a radio recognition device in a conventional pallet to equip container carriers such as pallets with information recognition capability. The information is attached to the pallet container. The information may be captured quickly in the distribution process to enhance operation efficiency and management control in the transportation and distribution.

7 Claims, 7 Drawing Sheets

PALLET APPARATUS EQUIPPED WITH A RADIO FREQUENCY RECOGNITION MODULE

FIELD OF THE INVENTION

The invention relates to a pallet apparatus adopted for use in distribution, storage, transportation and movement and particularly to a pallet apparatus that is equipped with a radio frequency recognition module.

BACKGROUND OF THE INVENTION

In complicated distribution, storage, transportation and conveying processes, container carriers such as pallets are often being used to stack and transport goods to increase operation efficiency. Using the pallets, suppliers can stack goods easily and deliver the goods to customer sites. Similarly, the suppliers or customers can also use the properties of pallets that are easy to move and stack, to classify and manage merchandising and products.

To facilitate transportation of goods and distribution of the pallets, some vendors deliver the goods with the pallets to customers, and retrieve the pallets at the next shipment. However, such a practice is prone to create complaints. As the pallets, which are shipped with the goods by the upstream suppliers to customer sites, are often stored in warehouses, they cannot be retrieved quickly. The pallets often reclaimed by the suppliers are used and worn pallets of the same size. They become a loss to the upstream suppliers and disputes arise. To avoid such a situation, some upstream suppliers directly stack the goods on customer's pallets during shipment so that the pallets may be reclaimed directly. However, such a practice incurs increased costs and lower operation efficiency.

Present enterprises, using pallets to transport goods in the distribution operation, often employ bar codes to stick to the pallets or goods. The bar code stickers tend to drop and do not last long. Moreover, as the pallets often are used to hold goods and moved in factories, impact and scraping of the bar code stickers occur frequently. The bar codes are often worn and smeared, or lost. As a result, the pallets could become unrecognizable. Furthermore, bonding and maintaining the bar codes with human labor are costly. This is not suitable for mass application. Some vendors try to use radio frequency identification (RFID) on the pallets by bonding the RFID labels to the pallets. However, in such a method the RFID labels are easily damaged or lost, due to impact during transportation.

SUMMARY OF THE INVENTION

In order to resolve the aforesaid problems, the invention aims at providing a pallet apparatus equipped with a radio frequency recognition module that couples a radio recognition device to a pallet so that the pallet may be detected and identified by a reader.

The pallet apparatus equipped with a radio frequency recognition module of the invention couples a well-developed and low cost RFID to the pallet. The identification code in the PFID can be recognized by a reader to identify the pallet easily.

The invention also provides different bonding methods for the most commonly used wooden pallets and plastic pallets. The bonding for the wooden pallet is accomplished by inserting a coupling member with a deep cavity formed on the pallet. For plastic pallets, a clip for holding the radio recognition device is provided and wedged in a cavity formed on the pallet. Bonding is secured without the risk of dropping or being damaged by impact. The function of radio recognition is provided. It can be used to maintain the existing structures without increasing the costs greatly.

The foregoing, as well as additional objects, features and advantages of the invention, will be more readily apparent from the following detailed description, which proceeds with reference to the accompanying drawings.

DESCRIPTION OF THE PREFERRED EMBODIMENTS

The invention aims to employ Radio Frequency Identification (RFID), capable to withstand harsh environments to overcome the recognition problems occurred to conventional techniques. A radio recognition device is a high-tech product that combines information and transmission capabilities. It uses IC chips to store ID data and information (or called ID code), and uses a radio frequency to exchange data and information. It must be coupled with a reader that receives the same frequency range. In general, the RFID can be grouped in active and passive types. Both of them are based on the same basic principle. The only difference is the originality of the radio frequency.

The pallet, whether it is made from wood or plastics, generally has a loading surface and a plurality of support legs to hold the loading surface. The most commonly used pallets are wooden pallets and plastic pallets. Their structure and fixing means are described as follows, with reference to the accompanying drawings:

1. Wooden Pallet

Figure 1:
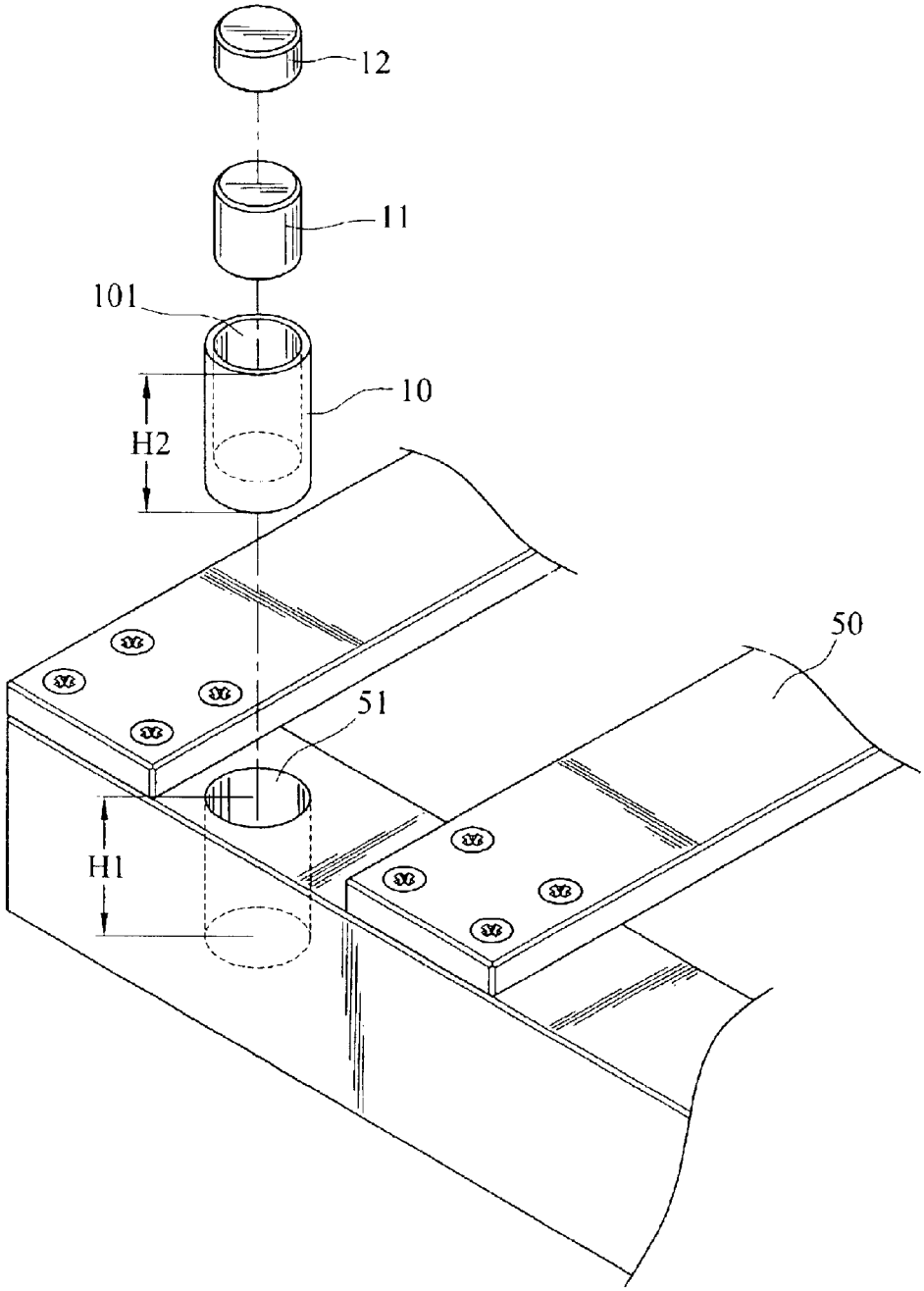
FIG. 1 is an exploded view of a first embodiment of the invention.
Figure 2:
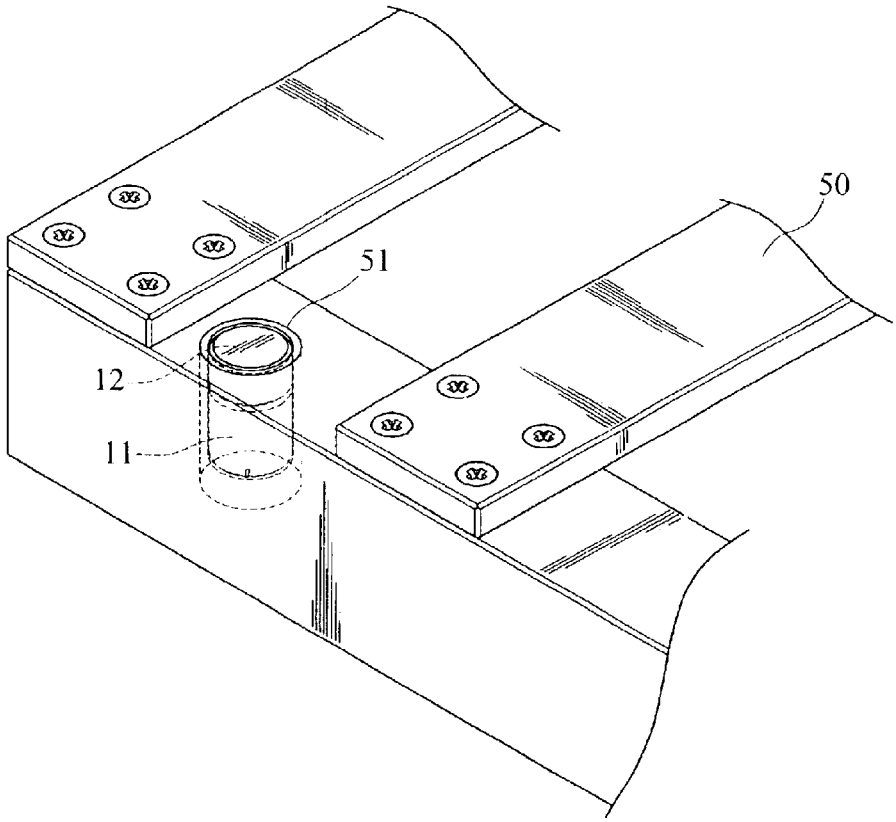
FIG. 2 is a schematic view of the invention in a bonding condition.

Referring to FIG. 1 for a first embodiment of the invention for use on a wooden pallet 50. As the wooden pallet 50 does not have spared space to accommodate a radio recognition device 11, a round and deep cavity 51 is drilled and formed on the wooden pallet 50 without running through. The radio recognition device 11 is housed in a round accessory, which includes a cup 10 having an outer diameter slightly larger than the cavity 51. The cup 10 has a housing compartment 101 for holding the radio recognition device 11. The cup 10 is covered by a cap 12 to seal the housing compartment 101, then is inserted into the cavity 51 (as shown in FIG. 2). As the outer diameter of the cup 10 is slightly larger than the inner diameter of the cavity 51, the cup 10 may be tightly squeezed into the cavity 51 to form a secured bonding. The cavity 51 has a depth H1 slightly greater than the height H2 of the cup 10 so that the cup 10 does not extend outside the surface of the wooden pallet 50. In order to avoid the radio recognition device 11 from being damaged and loosened off from the wooden pallet 50 during transportation, the position of the cavity 51 is preferably located where the support legs are formed. Of course, the radio recognition device 11 may be formed in a shape other than the round one as long as a mating design is adopted.

2. Plastic Pallet

Figure 3:
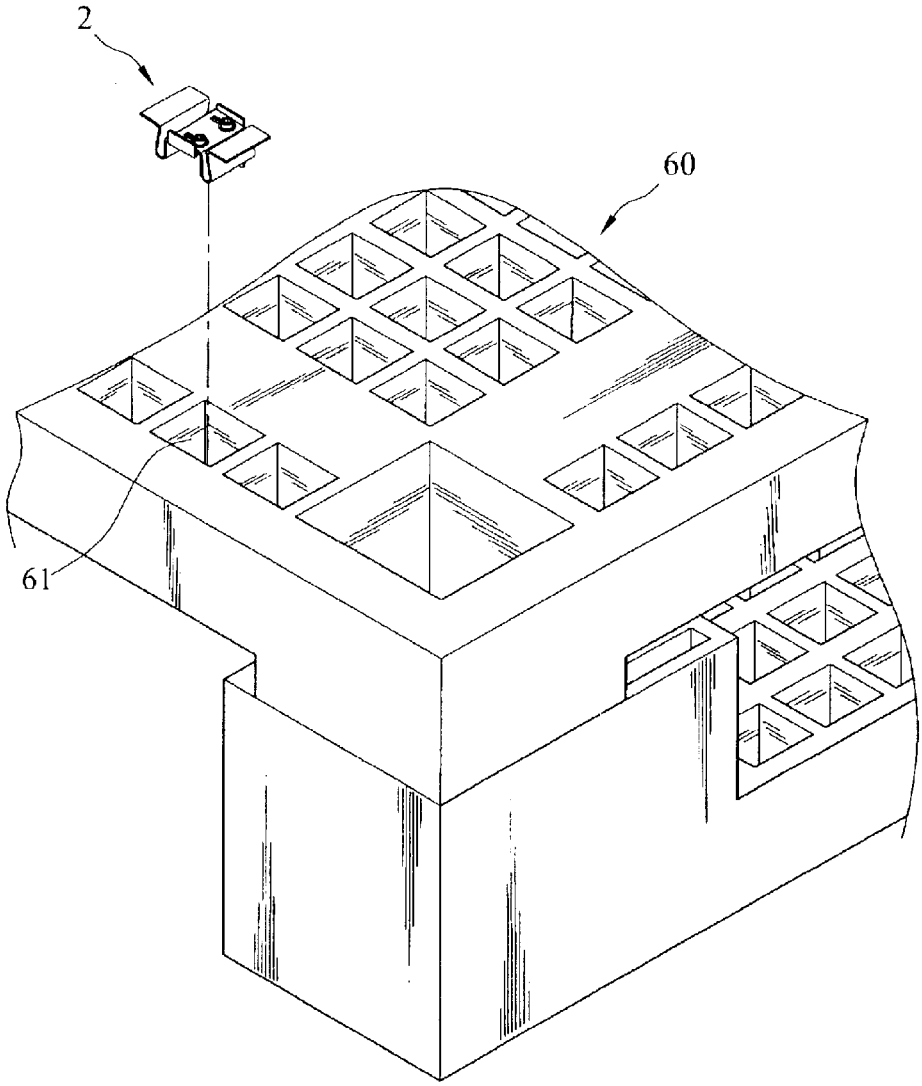
FIG. 3 is a perspective view of the first embodiment of the invention.

The plastic pallets, produced by vendors, mostly are made-in-order according to customer's dimensional specifications and loading requirements. In order to balance the structural strength and material consumption, they are usually formed like a honeycomb structure with square or round cavities. There is generally no standard specification for the cavities. Thus the size and number of the square cavities on the plastic pallet surface 60 vary. Nevertheless, there is always a cavity 61 as shown in FIG. 3. The invention aims at targeting such a cavity 61 to design a clip 2 to hold the RFID in the plastic pallet 60. Moreover, considering that the plastic pallet 60 is often being moved by lifters, to avoid damages from occurring, the cavity 61 is preferably formed where the support legs are located or not running through the plastic pallet.

Figure 4:
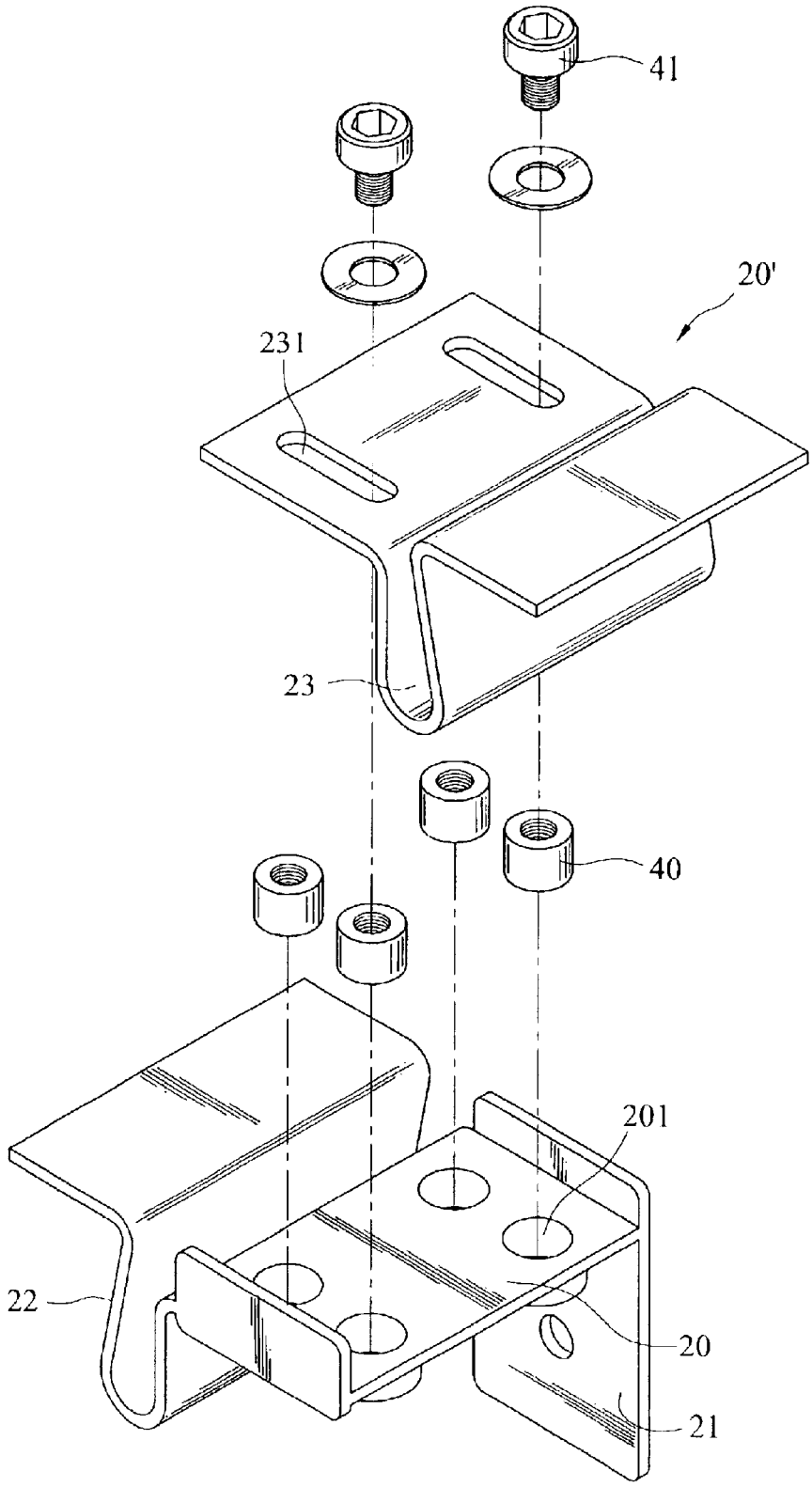
FIG. 4 is an exploded view of a second embodiment of the invention.
Figure 5:
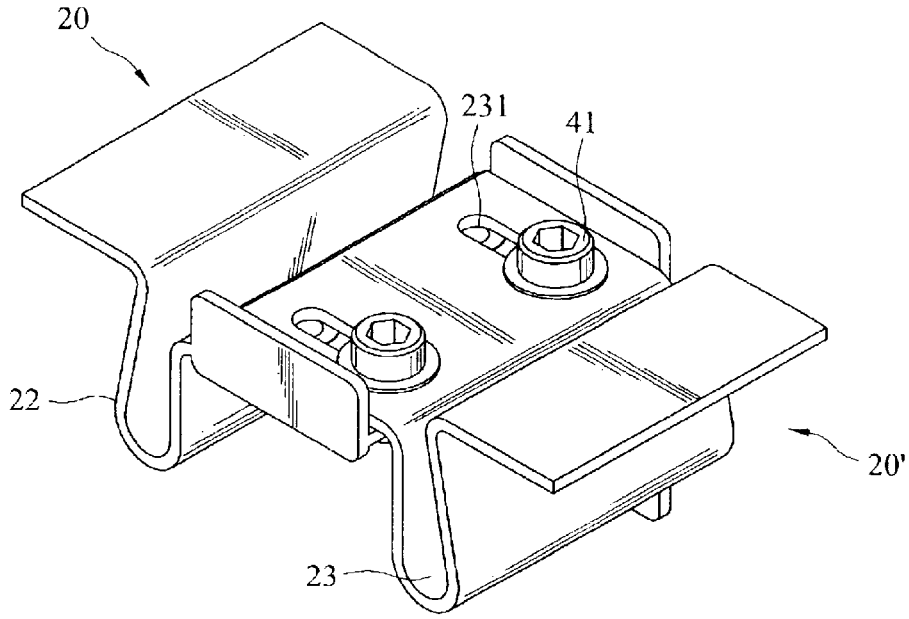
FIG. 5 is a perspective view of a second embodiment of the invention in a bonding condition.
Figure 6:
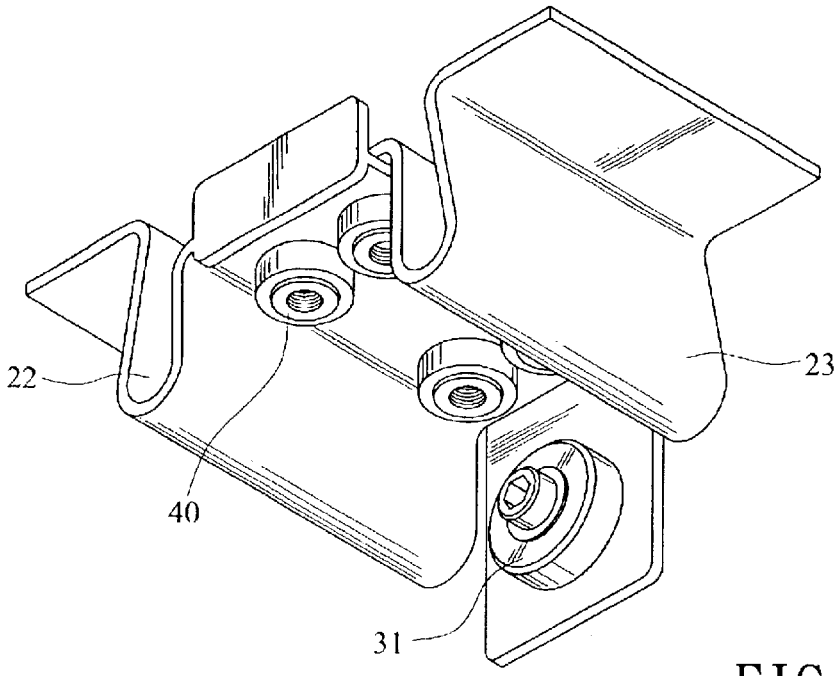
FIG. 6 is a schematic view of a second embodiment of the invention in a first application condition.
Figure 7:
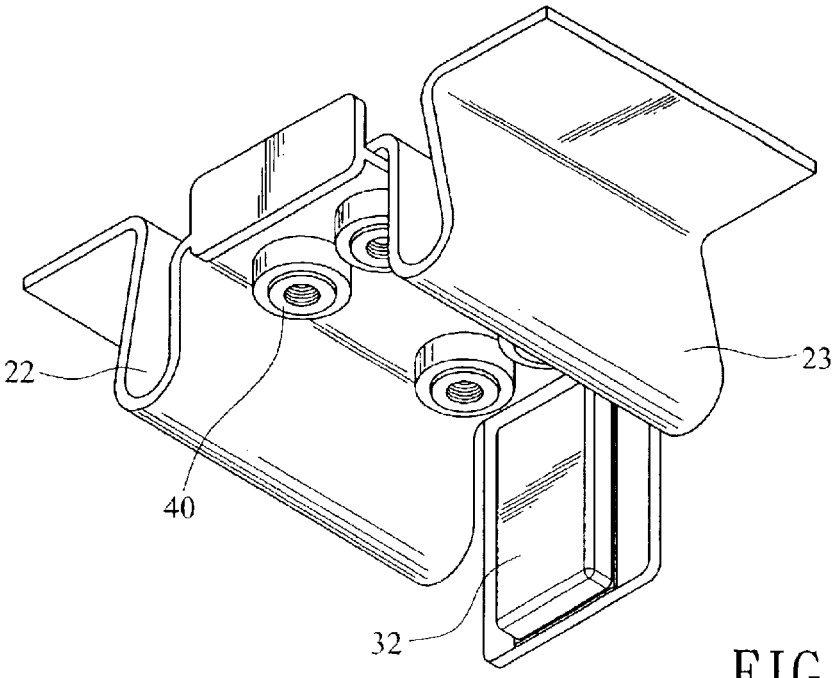
FIG. 7 is a schematic view of a second embodiment of the invention in a second application condition.
Figure 8:
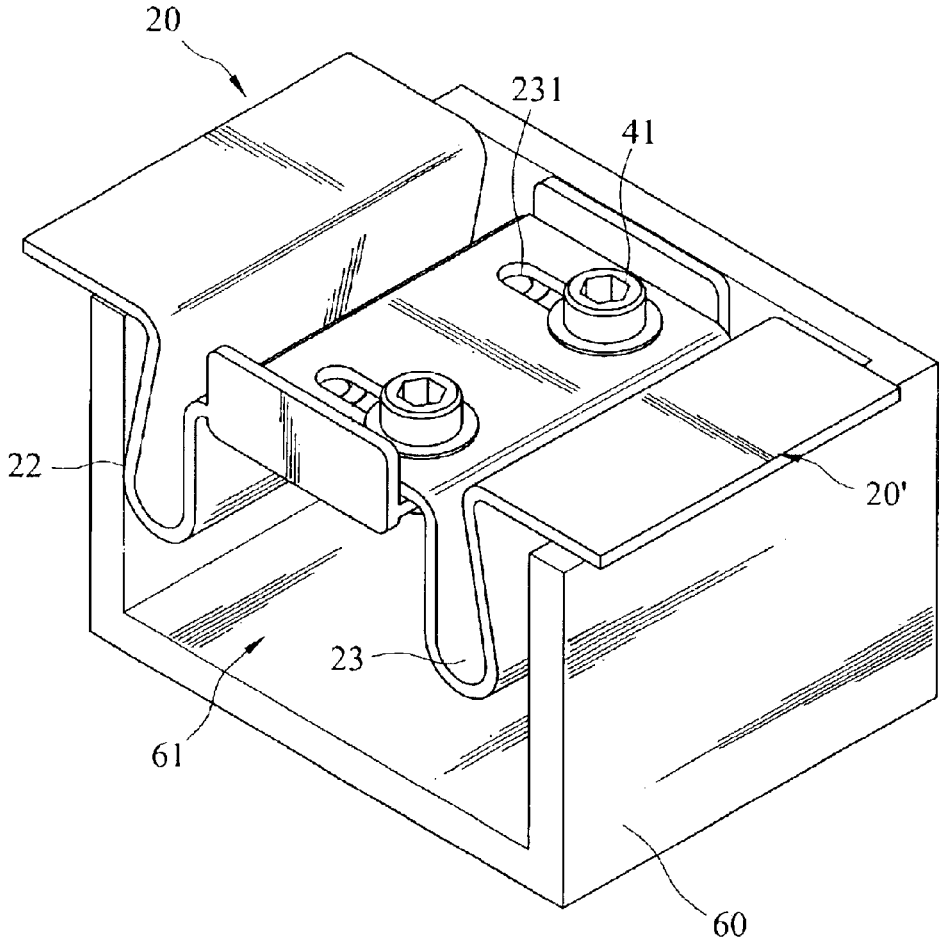
FIG. 8 is a schematic view of a second embodiment of the invention in use.

Refer to FIGS. 4 and 5 for a second embodiment of the invention that targets the plastic pallet. It includes a lower body member 20 and an upper body member 20' that have respectively a flexible latch section 22 and 23 extending downwards from two sides. The lower body member 20 further has a carrier section 21 extending downwards for holding a radio recognition device such as a round RFID 31 (referring to FIG. 6) or a square RFID 32 (referring to FIG. 7). The lower body member 20 has fastening holes 201 formed on an upper side thereof to couple with nuts 40, which are engaged with screws 41 running through the upper body member 20', to form a secured fastening with the upper body member 20'. The flexible sections 22 and 23 are fixed after the upper and lower body members have been coupled. The whole clip, thus made, is elastic and flexible on two sides, and may be latched into the cavity 61 of the plastic pallet 60. Referring to FIG. 8, in order to couple with the cavity 61 of different sizes, the body member 30 of the clip may also have slots 301 for adjustment.

By means of the designs set forth above, the invention can be used for a long period of time without dropping, or smearing by external materials. It also is easy to unfasten and remove. It can be easily adapted to newly made or existing plastic pallets 60. In addition to providing recognizable pallets for different vendors, it also can be used by the same vendor, to differentiate stocks and inventory held on the pallets.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments not departing from the spirit and scope of the invention.

What is claimed is:

1. A pallet apparatus equipped with a radio frequency recognition module detectable and recognizable by a reader, comprising:

a pallet having a loading surface and a plurality of support legs connected to the loading surface for supporting the loading surface, wherein the pallet is a plastic pallet which has at least one cavity located on the loading surface;

a radio recognition device located in the pallet having an identification code detectable and recognizable by the reader; and a clip for engaging with the cavity to house the radio recognition device;

wherein the clip includes a body member which extends downwards to form a carrier section for holding the radio recognition device, and two flexible latch sections extended outwards from the body member abutting two sides of the carrier section and being flexible inwards to engage with two opposing inner wall surfaces of the cavity.

2. The pallet apparatus of claim 1, wherein the clip is engaged with the cavity which is corresponded to where the support legs are located.

3. The pallet apparatus of claim 1, wherein the clip further has an adjustment section for adjusting relative positions of the two flexible latch sections.

4. The pallet apparatus of claim 3, wherein the clip has slots to adjust relative positions of the two flexible latch sections.

5. The pallet apparatus of claim 4, wherein the lower body member is extended downwards to form a carrier section for holding the radio recognition device.

6. The pallet apparatus of claim 4, wherein the lower body member is engaged with a nut for fastening the upper body member.

7. The pallet apparatus of claim 1, wherein the body member includes an upper body member and a lower body member.

* * * * *